US006684565B2

(12) United States Patent
Kemp et al.

(10) Patent No.: US 6,684,565 B2
(45) Date of Patent: Feb. 3, 2004

(54) SELF-STANDING DISPLAY DEVICE

(76) Inventors: Danny W. Kemp, 32 Wentworth Way, Lowestoft, Suffolk NR33 9JJ (GB); Robert H. Harris, 4 Fairfield Drive, Lowestoft, Suffolk NR33 8QG (GB)

( * ) Notice: Subject to any disclaimer, the term of this patent is extended or adjusted under 35 U.S.C. 154(b) by 0 days.

(21) Appl. No.: 10/074,652

(22) Filed: Feb. 12, 2002

(65) Prior Publication Data

US 2002/0129551 A1 Sep. 19, 2002

(51) Int. Cl.[7] ..... A01G 9/02
(52) U.S. Cl. ..... 47/83

(56) References Cited

U.S. PATENT DOCUMENTS 101,918 A * 4/1870 Rogers ..... 47/39
307,936 A * 11/1884 Fry ..... 47/41.01
D207,915 S * 6/1967 Zimmerman ..... D11/152
5,309,671 A * 5/1994 Byun ..... 47/83
5,438,797 A * 8/1995 Lendel ..... 47/82
5,450,691 A * 9/1995 Christie et al. ..... 47/83
5,502,922 A * 4/1996 Shlomo ..... 47/62 R
5,826,375 A * 10/1998 Black ..... 47/67
6,029,937 A * 2/2000 Funaro ..... 248/146
6,092,333 A * 7/2000 Steffan ..... 47/83

* cited by examiner

*Primary Examiner*—Charles T. Jordan
*Assistant Examiner*—Francis T. Palo
(74) *Attorney, Agent, or Firm*—Lilling & Lilling P.C.

(57) ABSTRACT

A self-standing display device for displaying flowers or the like includes a base and one or more columns rising from the base. The display device also comprises a number of display units each in the form of a walled vase-like retainer. Connector members are provided to link the or each display unit removably to either the base or to another display unit as appropriate. A connector member engages corresponding bosses on either the base or the other display unit respectively so that a stack of such units can be built up as desired. The or each vase-like retainer, in use, retains its own associated flower and/or display with no inherent limitation on the vase-like retainer size or form.

6 Claims, 13 Drawing Sheets

A

B

C

SELF-STANDING DISPLAY DEVICE

FIELD OF THE INVENTION

The field of the invention relates to a self-standing display device for displaying objects, the device being particularly applicable for displaying cut or dried flowers, foliage and the like.

BACKGROUND OF THE INVENTION

The use of containers such as pots or vases, firstly to physically hold a number of cut or dried flowers in a desired display arrangement and secondly to be aesthetically pleasing in their own right, and contribute to the said arrangement is well known.

Throughout this specification the term 'flowers' should be taken to include flowers—both cut and dried—and foliage, plants in soil, as well as three-dimensional artistic works, such as sculpture.

Similarly, "flowers or the like" is intended to indicate such elongate display items as pens, combs, etc. as being amongst the unexpectedly advantageous uses of the invention. A typical vase comprises a receptacle, capable of retaining water, into which the stalks of cut flowers can be inserted. The water normally acts to prolong the length of time in which the flower retains a freshly cut appearance. The vase can naturally be used without the water where dried flowers are to be displayed. A number of modifications on the basic design of vase are known. For example, vases are known which have the feature of more than one area available in which a plant or other decorative feature can be placed. This can take the form of a lid having a plurality of holes through which plant stalks are placed.

The vases as described above have a number of disadvantages. Firstly, the vase is usually of a fixed height and so cannot be modified to accommodate flowers or decorations of a length for which the vases are suited. This is a particular problem where the stem of a cut flower is cut back by small amounts during display the cutting increasing the display life of the flower. A number of suitable vases must therefore be kept by the user, which can require a large storage space. Secondly, where the case has one or more distinct parts, such as a lid described above, if one of these parts breaks the whole vase becomes unusable, and must be thrown away. Thirdly, certain vases, particularly those having a long thin shape are difficult to clean, and can attract unwanted algal growth if not cleaned and dried sufficiently well.

It is an object of the present invention to provide a vase which addresses the above problems.

The following patent specifications are the most relevant currently known to the applicant:

GB 2 280 344A

US 5 577 344

SUMMARY OF THE INVENTION

In its broadest aspect, the invention presents a self-standing display device for displaying flowers or the like, the display device comprising: a base; display unit means in the form of a walled vase-like retainer; connecting means linking such display unit means removably to one of the base and another display unit as appropriate, receiving means being provided on one of said base and said display unit means to engage a corresponding connecting means, whereby a stack of such units can be built up as desired and wherein said connecting means and said receiving means, when engaged together, are rotatable relative to one another, whereby the position of the display unit means may be adjusted by the user of said device when the device is assembled.

In a subsidiary aspect of the invention, the receiving means of the display unit means comprises boss means projecting to a height which is substantially the same as the height of the wall of its associated display unit. According to a further subsidiary aspect of the invention, the height of the vase-like retainer means measures at least one fifth of the measurement across the rim of the vase-like retainer means. This feature is particularly advantageous because it provides the display device with greater stability as it optimises distribution of the weight and bending moment in the display device.

A further subsidiary aspect of the present invention becomes apparent when said boss means projects to a height which is more than the height of the wall of its associated display unit.

This feature is particularly advantageous because when the boss means projects past the height of the wall of the display unit, it enables the space between the display units to be increased without requiring the insertion of spacers.

In a subsidiary aspect of the present invention, the display device comprises a column and boss means sufficiently hollow to allow the passage of the entire or part of the column through the entire height of said boss means.

This is particularly advantageous as it permits the stacking of the display units onto the column.

In a further subsidiary aspect of the invention, the diameter of the column decreases from its base to its top and the diameters of the bosses of the successive display units correspondingly decrease in order to space the successive display units.

This feature is particularly advantageous because it permits the stacking of the display units onto a column and spacing these apart without requiring the use of spacers.

The base can comprise a removable base unit on which the mass of the device is supported. The base unit can thus be made broader when required, to prevent the device from tipping over. The base unit can also be changed simply to alter or improve the aesthetic appeal of the device. For ease of attachment, the base unit is preferably threadably mounted to the self-supporting base. The base unit optionally includes a port through which a weighting material can be added to increase the mass of the base unit and stabilise the device when required. The base unit can optionally comprise a housing to receive ballast means.

The base preferably comprises one or more apertures to receive display objects, to afford the user greater flexibility in the placement of the display objects.

The display unit is preferably capable of retaining a liquid, to enable water and nutrients to be provided to, for example, plants or cut flowers supported by the display unit.

The display unit preferably comprises an integral surface into which a part of an object to be displayed can be inserted and retained. The arrangement of the objects is thereby facilitated. The surface is conveniently formed of a rigid foam which an also absorb water and nutrients.

The connector member of the or each display unit is advantageously of a generally tubular shape to enable it to be inserted into correspondingly sized receiving means on the base support unit. The connector member conveniently includes one or more seals to give a firmer grip and prevent any liquid accidentally entering the support. The or each display unit preferably includes receiving means to receive a connector member from another display unit. A larger display can be built by addition of display units onto each other.

The device may include a base having a plurality of receiver apertures adapted to receive the stalks of flowers. In such a case, one or more of the said apertures may also be adapted to receive one of the connecting members of the device.

BRIEF DESCRIPTION OF THE DRAWINGS

The invention will now be described with reference to the accompanying drawings which show by way of example, different embodiments of a cup and base assembly. In the drawings.

DETAILED DESCRIPTION OF THE INVENTION

In the following description, the vase-like retainers of the display devices are often referred to as cups. The term "vase-like retainers" covers a wide variety of different display units which can be, for example, but not limited to rectangular, square, semi-circular, triangular in cross-section.

The vase-like retainers are preferably non-plate like and therefore comprise a peripheral wall.

In order to sufficiently retain the displays in the vase and to optimise the distribution of the weight and bending moment in the display device, it is advantageous that the height of the wall measures at least one fifth of the measurement across the rim of the vase-like retainers.

Although this configuration is advantageous the invention is not limited to it and extends to vases of any shape or form as appropriate.

Figure 1:
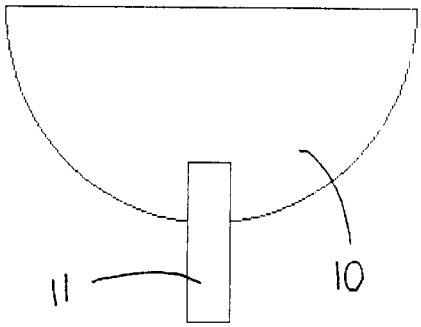
FIG. 1 is a sectional view of a cup assembly showing a first embodiment of a connector.
Figure 2:
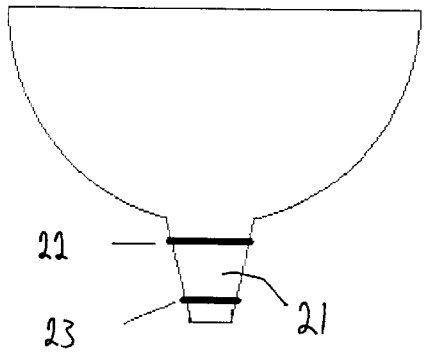
FIG. 2 is a side view of a cup assembly showing a second embodiment of a connector.
Figure 3:
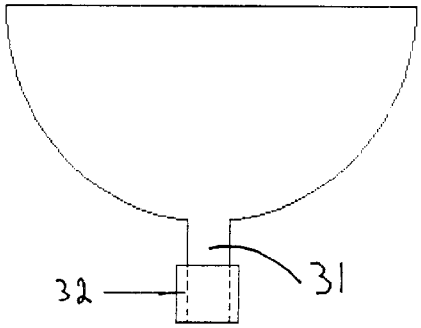
FIG. 3 is a side view of a cup assembly showing a third embodiment of a connector.
Figure 4:
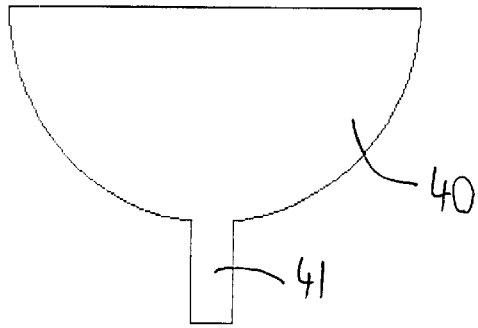
FIG. 4 is a sectional view of a cup having an integral connector.

Referring initially to FIGS. 1 to 4, these each show a cup having a generally semi-circular cross-section, and each having a connector piece. The connector piece 11 in FIG. 1 is a wooden dowel inserted into an aperture in the base of the cup 10. In FIG. 2, the integral connection 21 has two O-ring seals 22, 23. The integral connector 31 in FIG. 3 is generally tubular, and fits inside a connector plug 32. The cup 40 shown in FIG. 4 has an integral connector 41, of generally tubular shape.

Figure 5:
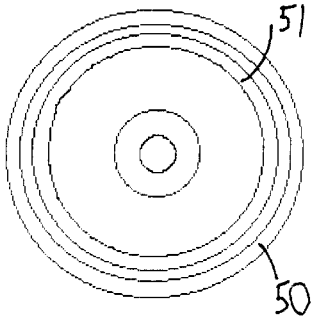
FIG. 5 is a top view of a cup having a trough to receive a display.
Figure 6:
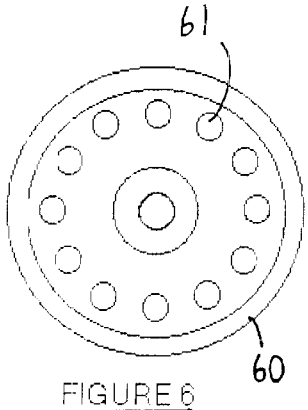
FIG. 6 is a top view of a cup having holes within the cup to receive a display.
Figure 7:
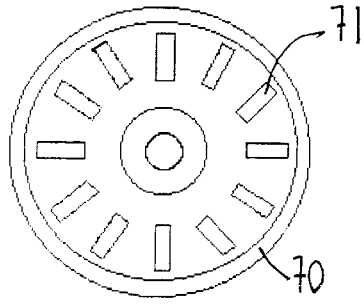
FIG. 7 is a top view of a cup having slots within the cup to receive a display.
Figure 8:
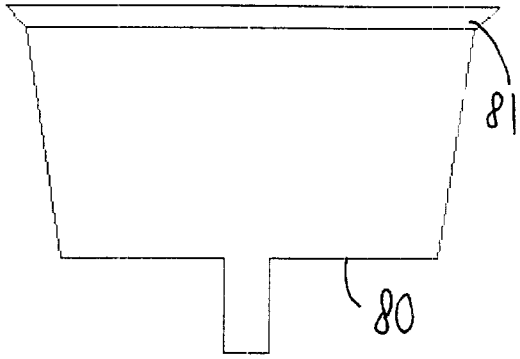
FIGS. 8 and 8*a* are, respectively, a side view and a top view of a cup having a generally rectangular cross-section.
Figure 8A:
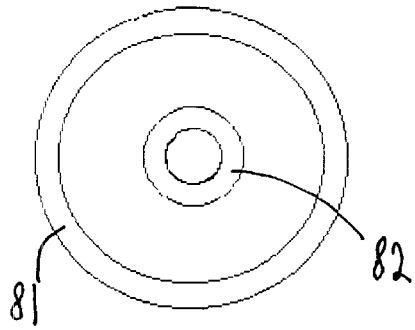
Figure 9:
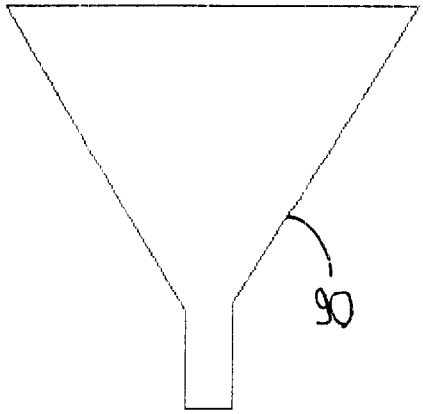
FIGS. 9 and 9*a* are, respectively, a side view and a top view of a cup having a funnel-shaped cup.
Figure 9A:
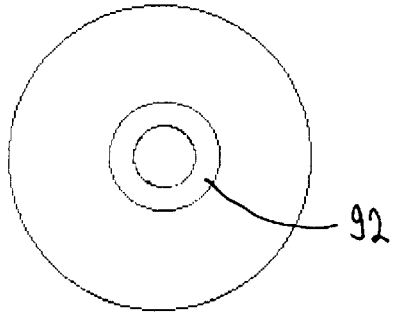
Figure 10:
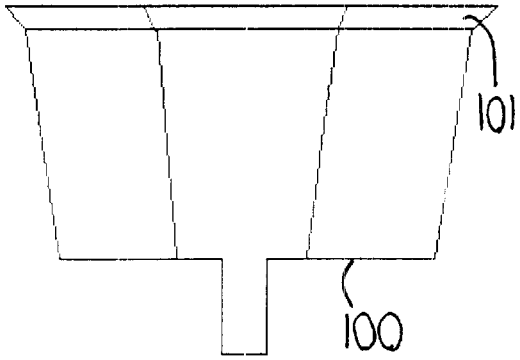
FIGS. 10 and 10*a* are, respectively a side view and a top view of a cup having an octagonal-shaped cup.
Figure 10A:
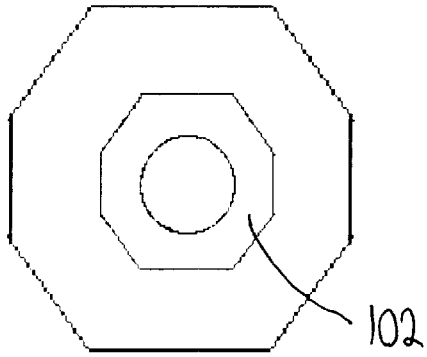
Figure 11:
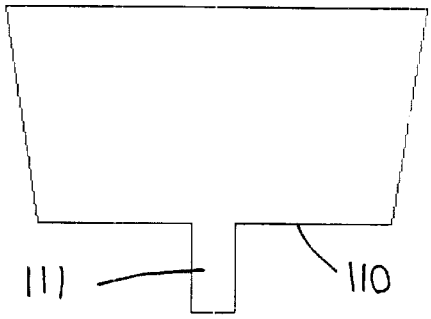
FIGS. 11 and 11*a* are, respectively, a side view and a top view of a cup having a rectangular cuboidal shape.
Figure 11A:
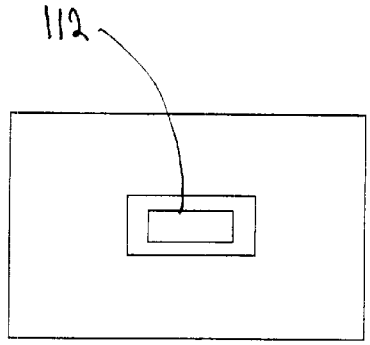
Figure 12:
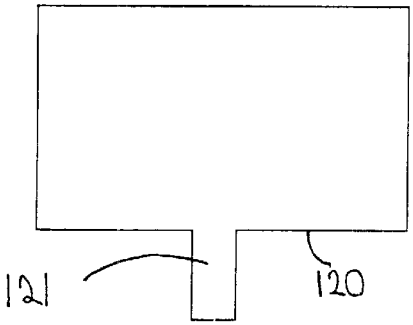
FIGS. 12 and 12*a* are, respectively, a side view and a top view of a cup having a generally square cuboidal shape.
Figure 12A:
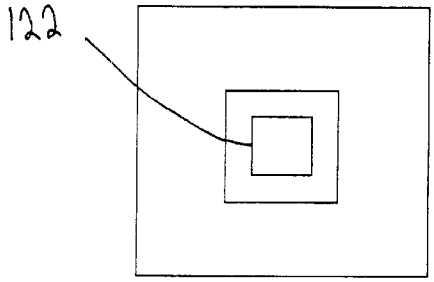

The cups can be provided with additional features as shown in FIGS. 5 to 7. For example, in FIG. 5, the cup 50 incorporates a trough 51 to receive one or more objects. However, in FIG. 6 the cup 60 has a number of circumferentially arrayed circular holes 61 to receive one or more objects. The cup 70 of FIG. 7 is similarly formed, except that the holes 71 are rectangular in shape.

The cup can also be formed in different shapes to accommodate different objects and also to improve or alter the aesthetic character of the assembled cup and base. Examples of this are given in FIGS. 8 to 10 and 8*a* to 10*a*. The cups 80, 90, 100 have, respectively, a base conic, a funnel, and an octagonal shape. Additionally, the cups 80, 100 each have a lip 81, 101 around the in-use upper edge. Furthermore, each of the cups 80, 90, 100 has a connector receiver 82, 92, 102.

The shape of the connectors can also be formed so as to improve the look as well as the overall stability of the finally assembled cup and base. The cups 110, 120 shown in FIGS. 11, 11*a* and 12, 12*a*, respectively, have connectors 111, 121 of rectangular and square cross-section. They also, correspondingly, have holes 112, 122 of the same cross-section to receive a connector from another cup.

Figure 13:
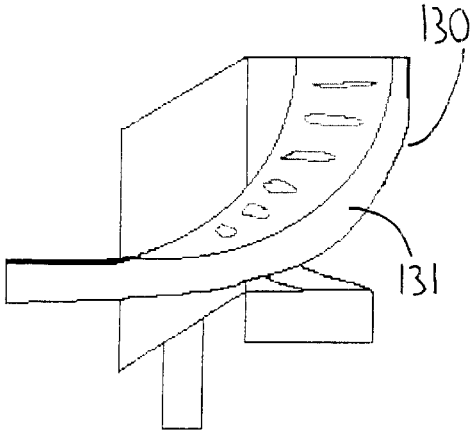
FIGS. 13 and 13*a* show a cup having a spiral outer portion.
Figure 13A:
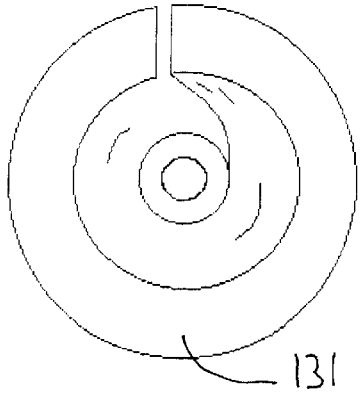
Figure 14:
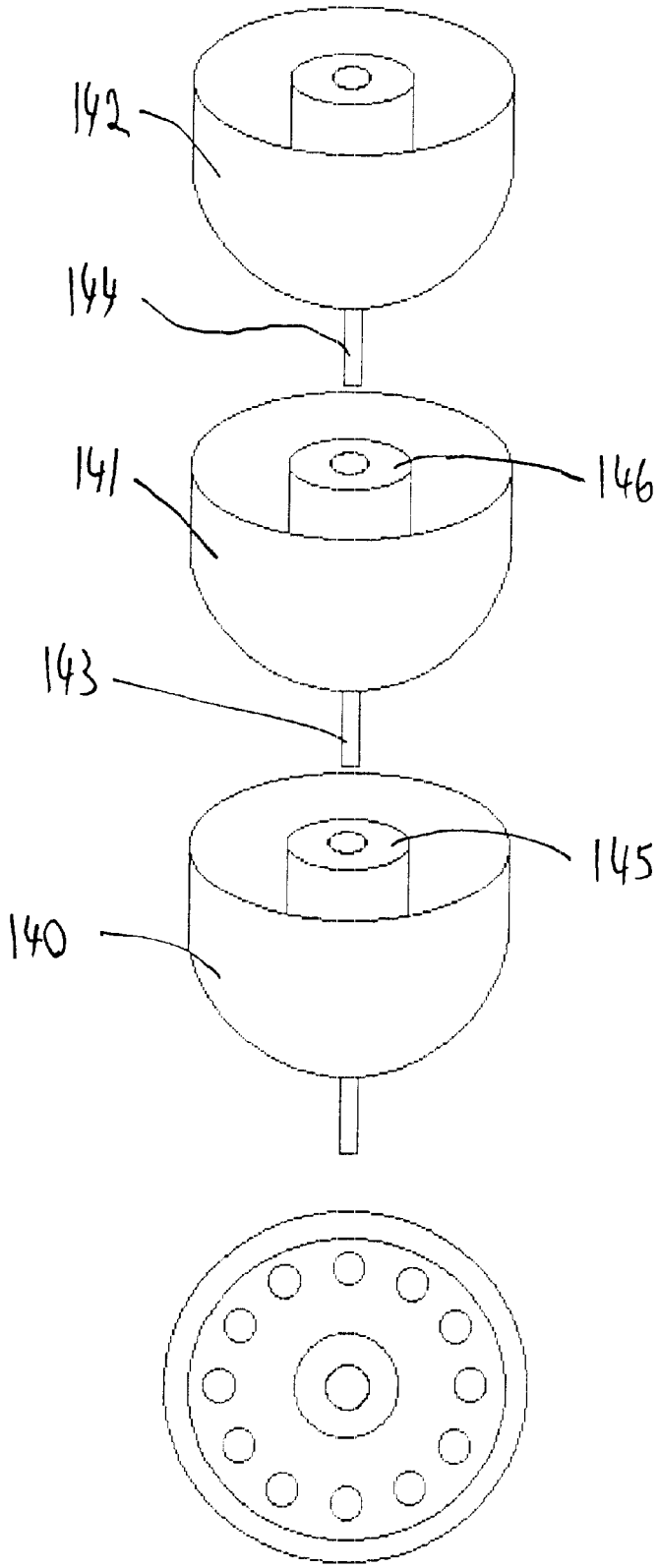
FIG. 14 is a perspective view of three cups prior to their assembly.
Figure 15:
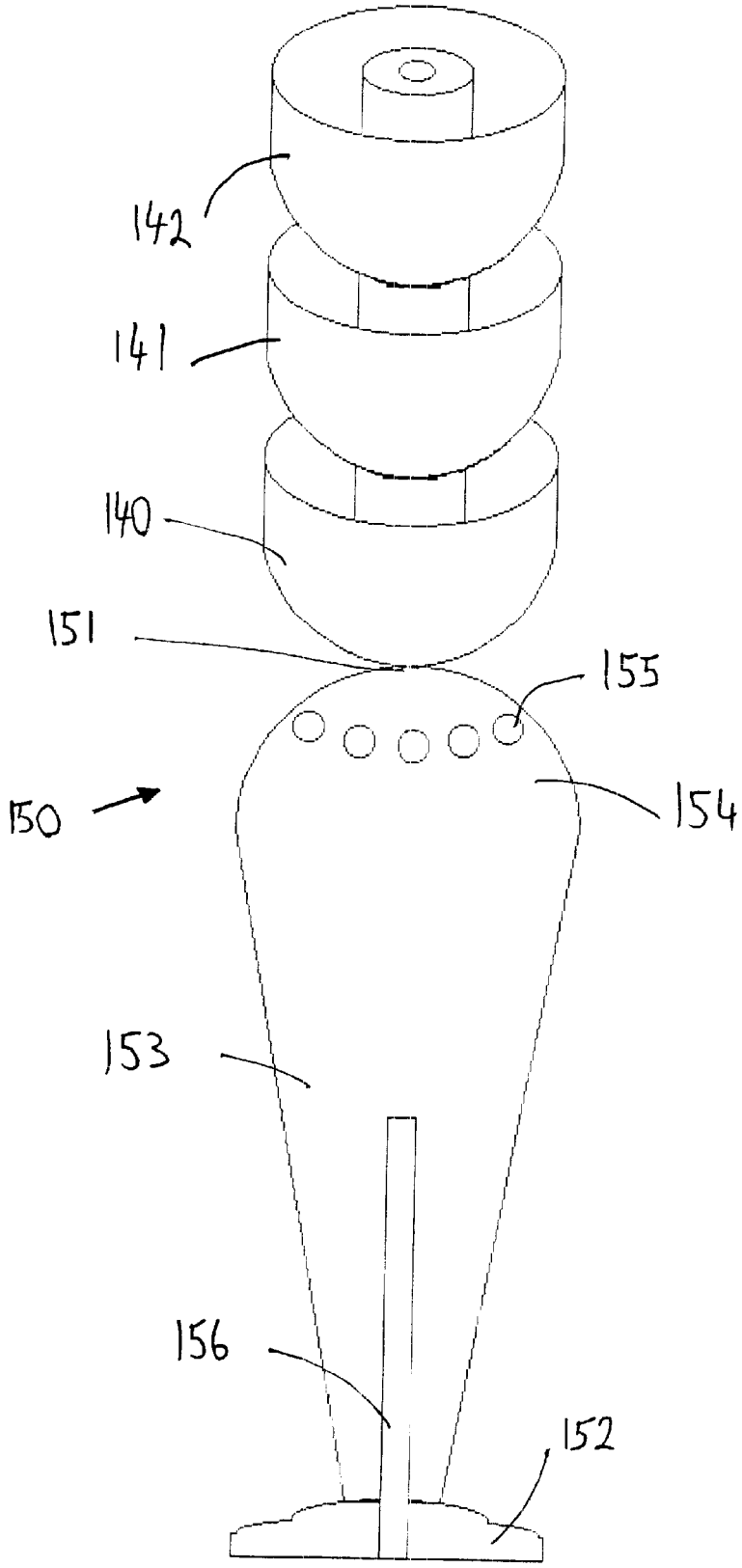
FIG. 15 is a perspective view of a cup and base assembly having three cups.

In FIGS. 13, 13*a* the cup 130 has an outer portion having a spiral configuration. The spiral 131 has an upper surface formed from a rigid foam material into which objects may be inserted and held by the foam material. FIG. 14 illustrates the relative position of the cups 140, 141, 142 prior to their being assembled together as part of the cup and base assembly 150, shown in FIG. 15. In these illustrations the cup shown is that depicted in FIG. 6, which is used by way of example. The individual cups 140, 141, 142 are aligned such that the connectors 143, 144 are aligned with the connector receivers 145, 146. The connector 143 of the lowest of the three cups 140 is inserted into a corresponding aperture in the base 151. The frictional engagement between the cups 140 and the base 151 is sufficient to retain the cups 140, 141, 142 in the correct vertical alignment. The base 151 has a stand 152 supporting a display body 153. The display body 153 has a hemispherical upper section 154, the hemispherical section having a number of holes 155 circumferentially arrayed. The base 151 has further, a weight 156 located within the stand 152 of the base 151 in order to lower the cup and vase's 150 centre of gravity and reduce the chance of the assembly tipping over.

In use, the connector of a first cup is inserted into the corresponding aperture in a base. If so desired, a further cup can be located into the connector receiver of this first cup. Where the cup and base assembly is to be used for displaying, for example, flowers then the stalks of the flowers can be inserted into the retaining means provided. The flowers are then arranged by the user to give the design and the effects required.

The means of retaining the flowers can be selected from one of the following. The surface of the cup or vase can have a rigid foam layer, of a type well known in floristry, laid on to it. The foam layer acts to retain the stalks in the orientation in which they are inserted into the foam layer, as well as providing a medium for the uptake of water and nutrients to sustain a flower and/or foliage. Alternatively or additionally, the vase and/or the cup can have a number of holes through which the stalk of a flower can be passed to retain the flower. The cup or vase can also be filled, either partially or completely with a material such as soil, sand, grit etc. Once the stalk of the flower has been inserted into the material, the material acts to retain the stalk in position. In addition to providing support, where soil, sand or grit is used, the support can be used as a source of nutrients and water for the flower, particularly where the cup or vase is capable of retaining water.

In addition to the embodiments described above, a number of other modifications may be made to the vase and/or cup without departing from the scope of the invention. For example, the base can be removable, one means of connection to the remainder of the vase being a threaded connection. When required or desired therefore the base can be removed and either cleaned and reconnected to the vase. Alternatively, a new base can be added to change the look of the vase or increase the stability of the vase and base assembly if further vases are added or the centre of gravity is otherwise raised. The base can be hollow, having a port through which a relatively dense material can be added to increase the mass of the base.

The base can comprise means to indicate the number of cups which can be safely incorporated into the vase and base assembly before the centre of gravity becomes too high. For example, the number can be stamped or otherwise marked on the base The vase or cups and base can be formed from one or more materials, used for decorative items. These include wood (such as pine, mahogany etc.), glass, crystal, porcelain, metals (such as pewter, gold, silver, brass), plastics materials or pottery. Using the above materials, the vase and base assembly can be formed to the shape and configuration designed by the designer.

Figure 16:
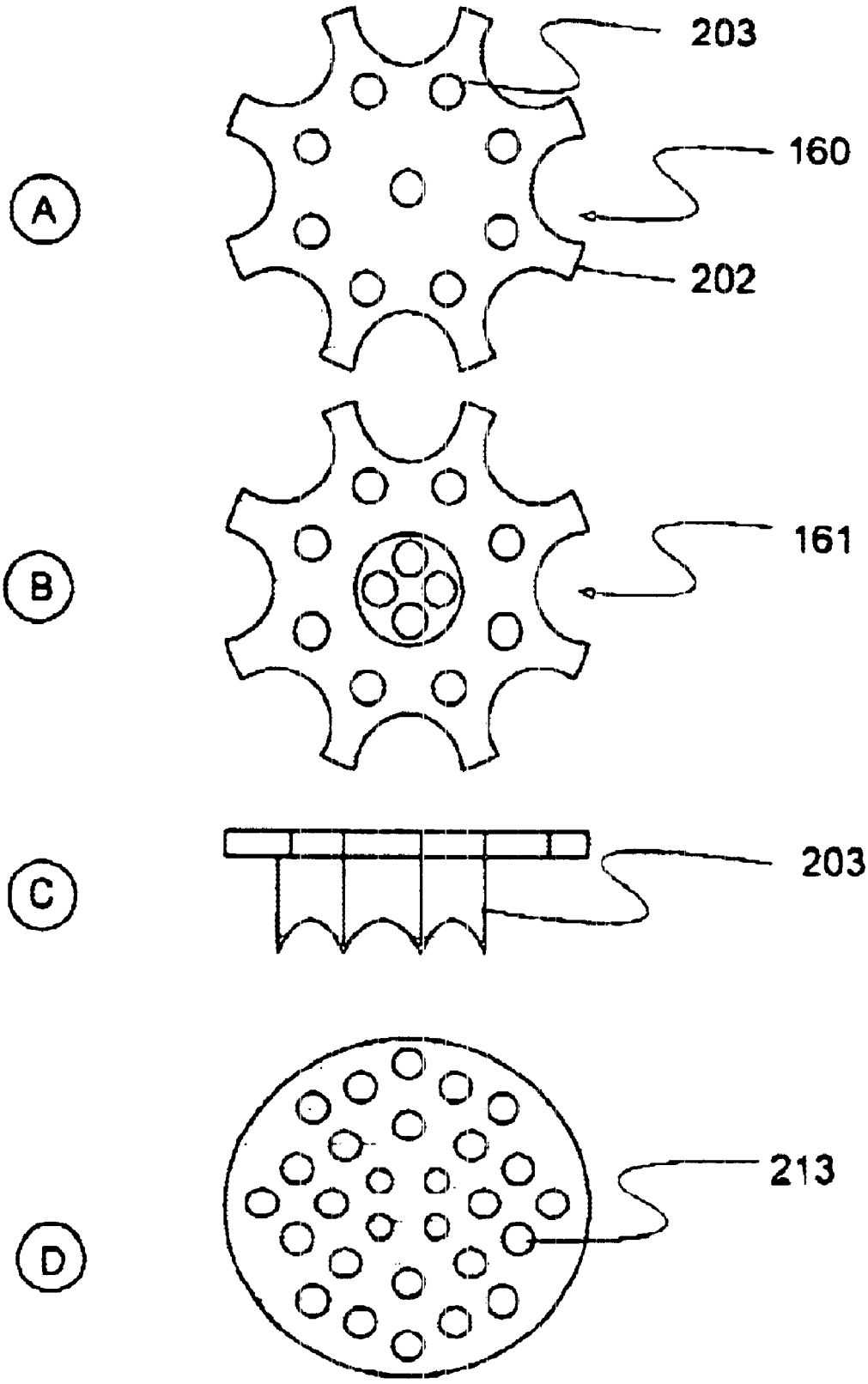
FIG. 16 show four different views of essentially circular top discs.

FIG. 16*a* shows a top disc which may be inserted into a display cup, in order to provide means for the insertion of flowers in preferred locations. The top disc 160. incorporates radially extending teeth 202 and holes 203. The semicircular space between each tooth 202 and the holes 203 will enable an easy insertion of the display flowers and will also permit the passage of water to a lower compartment of the cup.

The top disc 161 presented in FIG. 16*b* is of a similar geometry to the top disc of FIG. 16*a*. In this top disc, the unique central hole of FIG. 16*a* is substituted by four smaller central holes.

FIG. 16*c* shows a hollow projecting guide means which extends from the top disc. These will provide additional holding means to the flowers which are to be inserted in the top disc holes.

The top disc presented in FIG. 16*d* incorporates numerous small holes 213 which will render the insertion of flowers more precise. This arrangement may even enable individual flowers stalks to be held in their own holes.

Figure 17:
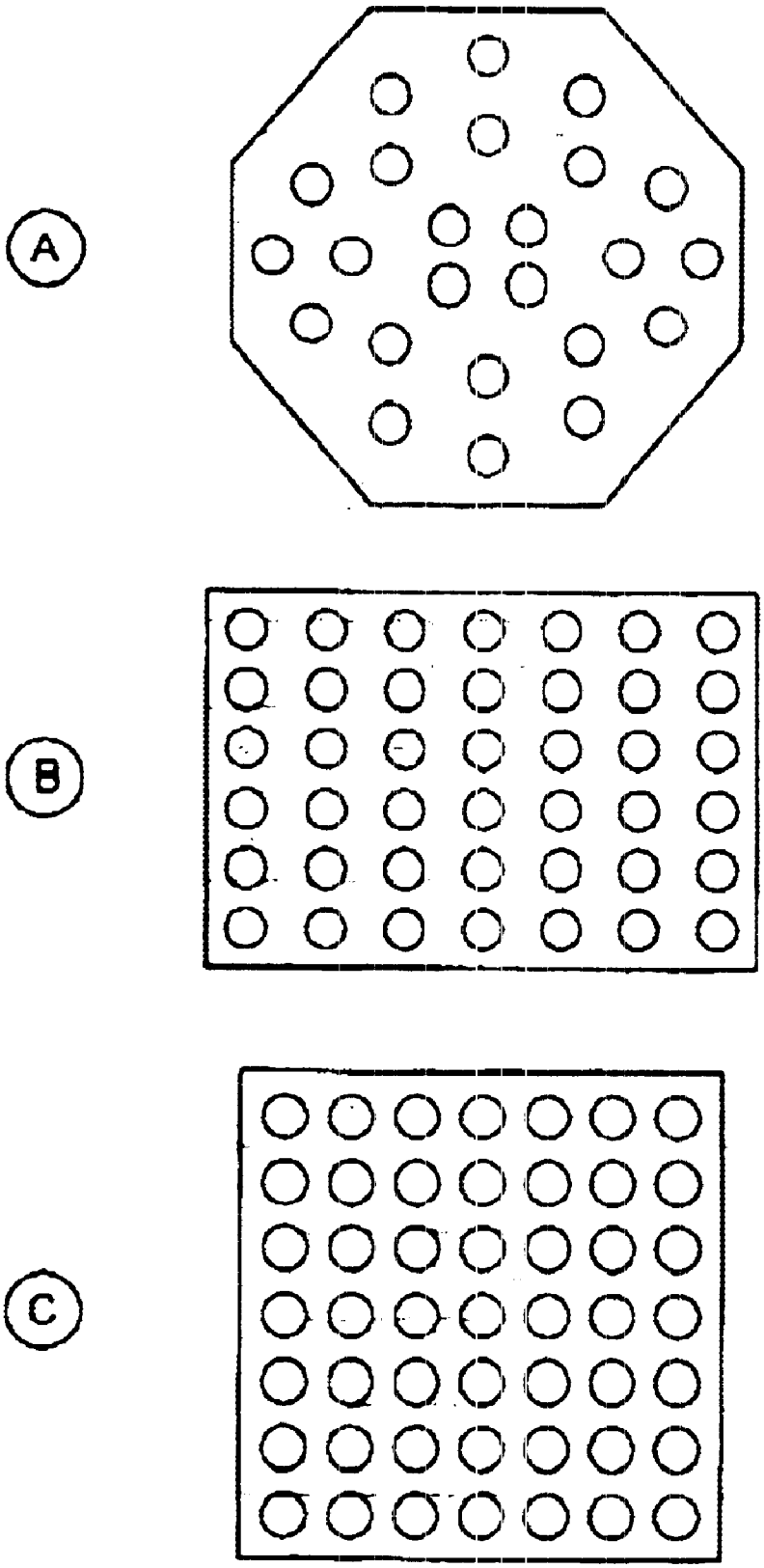
FIGS. 17*a*, 17*b* and 17*c* are, respectively, a top view of an octagonal top disc, a top view of a rectangular top disc and a top view of a square top disc.

FIGS. 17A–C show a series of top discs with respectively an octagonal, rectangular and square shape.

Figure 18:
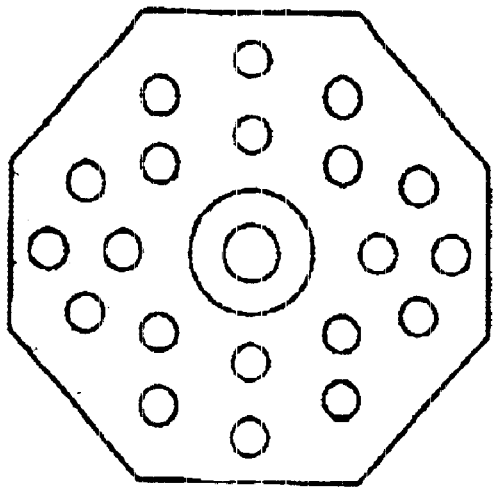
FIG. 18 are top views of cups into which intermediate discs have been inserted.
Figure 18:
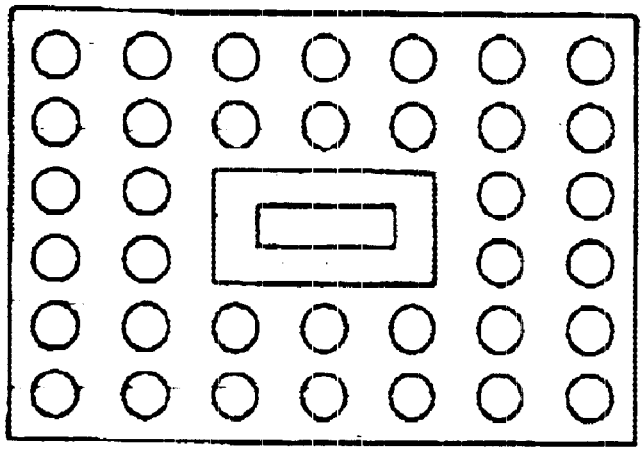
Figure 18:
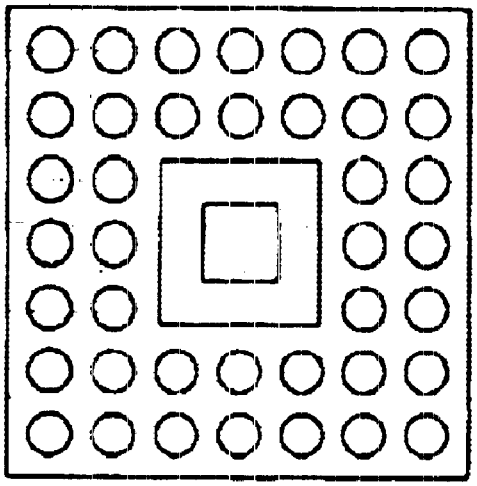
Figure 19:
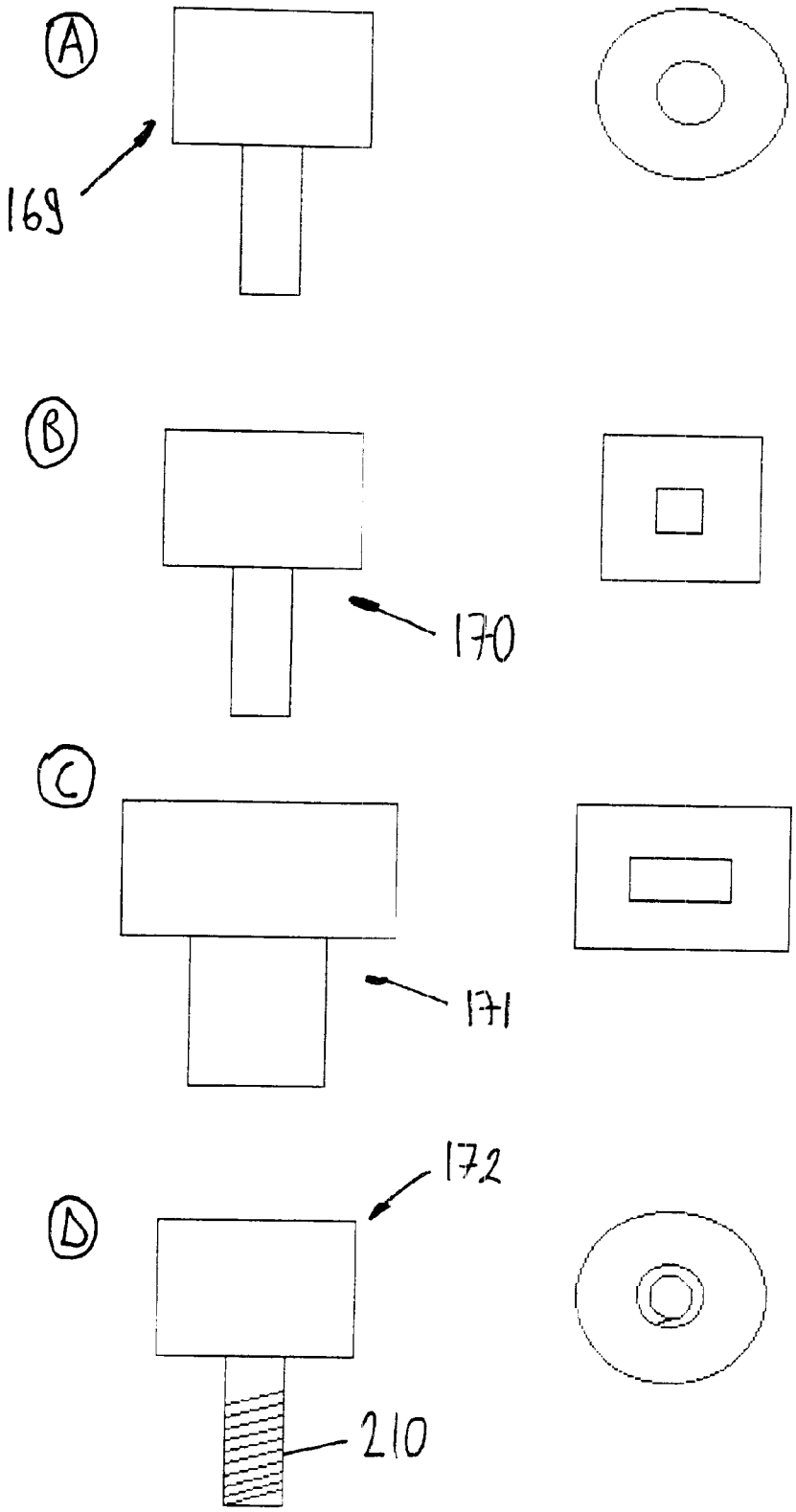
FIG. 19 show top views and side views or several spacers.

FIGS. 18A–C show a series of intermediate discs each of which presents an aperture sufficient to permit the passage of the connectors so that these discs may be used on intermediate cups.

As shown in FIGS. 19A–D, spacers of different geometry may be employed. These spacers are designed to be inserted between two display cups so as to increase the distance between the bottom wall of the top cup and the rim of the cup below it. The spacers 169, 170, 171 are inserted into the receiving means of the lower cup and retained in the lower cup by friction. Each of the spacers of FIG. 19 incorporate a receiving means themselves to facilitate the engagement of the connector of the higher cup. The connecting projection 210 of the spacer 172 comprises a thread which will threadably engage into a receiving means of a lower cup.

Figure 20:
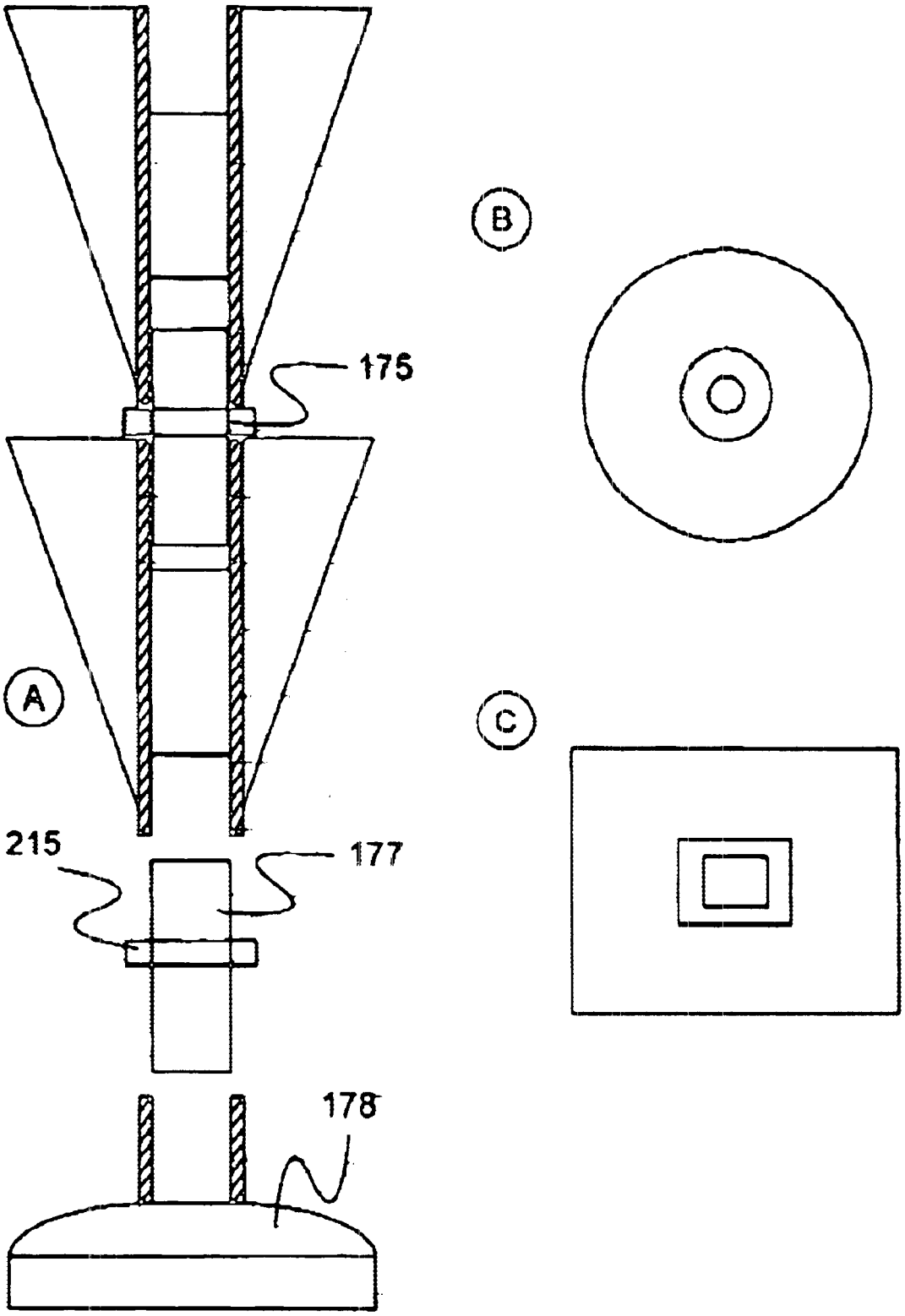
FIG. 20*a* presents a display device in side cross-sectional view.
FIG. 20*b* is a top view of a circular display unit.
FIG. 20*c* is a top view of a square display unit.

FIG. 20*a* shows how two cups have been mounted onto a base 178. The lower cup is connected to the base column via a connector member 177. The lower cup is interconnected to the higher cup via a connector member 175. Both of these connectors 175, 177 frictionally engage into apertures in the cups and in the base. Each connector member comprises a disc 215 which acts as a spacer and increases the separation between either the base and the lower cup or the lower cup and the higher cup.

The lower cup can also be adapted to act as a base when its geometry comprises a lower surface adapted to sit on the surface onto which the display device is to be placed.

Figure 21:
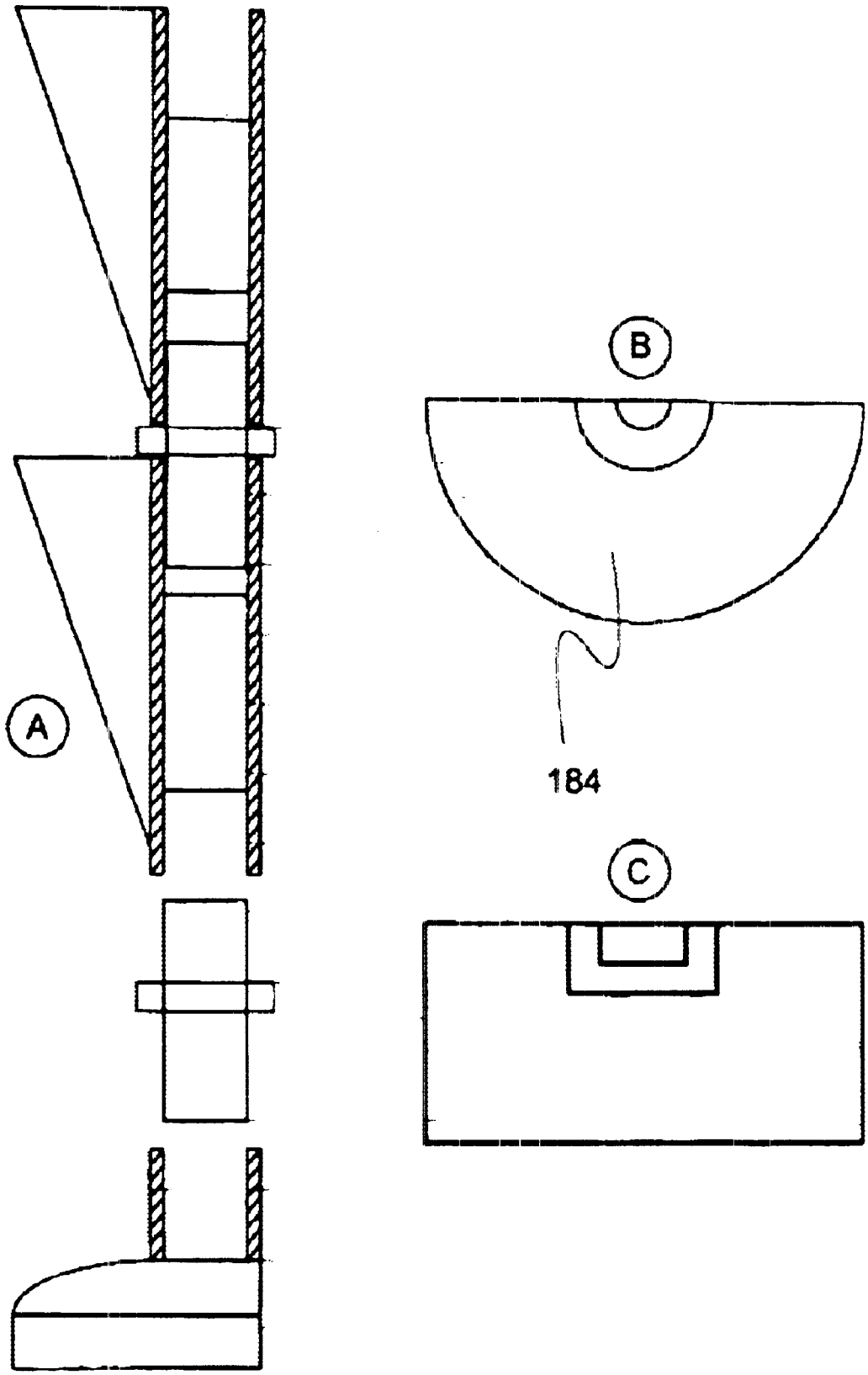
FIG. 21*a* is a side cross-sectional view of a display device incorporating one-sided display units.
FIGS. 21*b* and 21*c* show top views of different types of one-sided display units.

The cups in FIGS. 21A–C are one-sided. As shown in FIG. 21*b* the cup 184 in its top view is essentially semicircular. In this embodiment the connection of the different cups takes place at the flat side of the cups. This will enable the self-standing display device of the invention to be placed directly against a flat wall.

Figure 22:
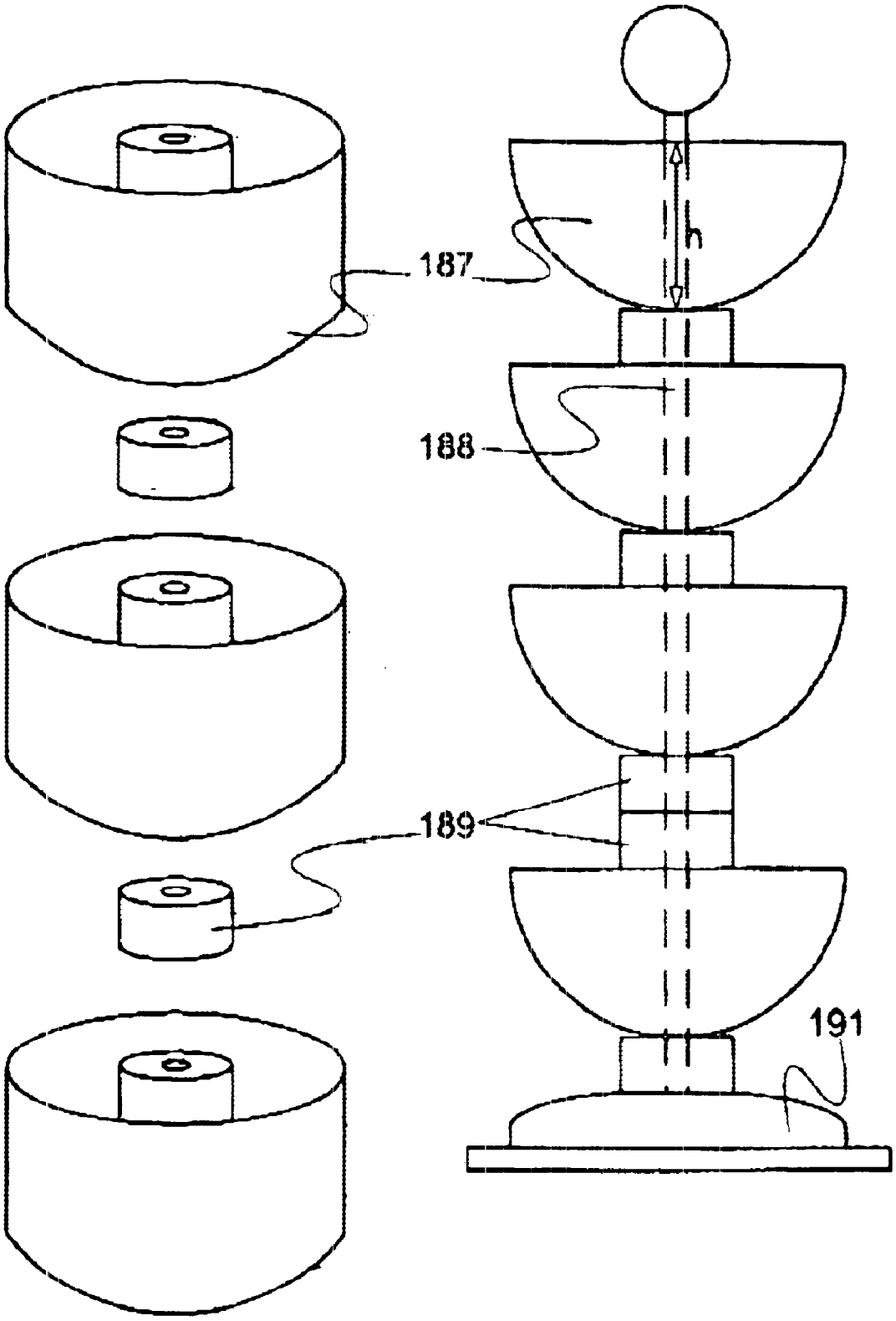
FIG. 22 show the assembly of cups and spacers onto a column.

In FIG. 22 the height h of the boss of each cup is equal to the height of the cups. The boss in this configuration is essentially a shaft extending from the bottom of the cup to the top of the cup. This enables the cups 187 and the spacers 189 to be successively stacked onto the base's column 188. The assembly of the column 188 and the cups and spacers is secured in the vertical direction by a top element which may be threaded into the top of the column 188.

The configuration presented in FIG. 22 can be modified into a configuration where the spacers form an integral part of the bosses 186 so that the height of the boss is more than the height of the wall of its associated display unit.

In a further variation of the configuration of FIG. 22, the diameter of the column 188 can be made to decrease from its base to its top and the diameter of the bosses 186 of the successive display units can correspondingly decrease so that the cups are held at spaced locations on the colum without requiring the use of spacers 189.

Figure 23:
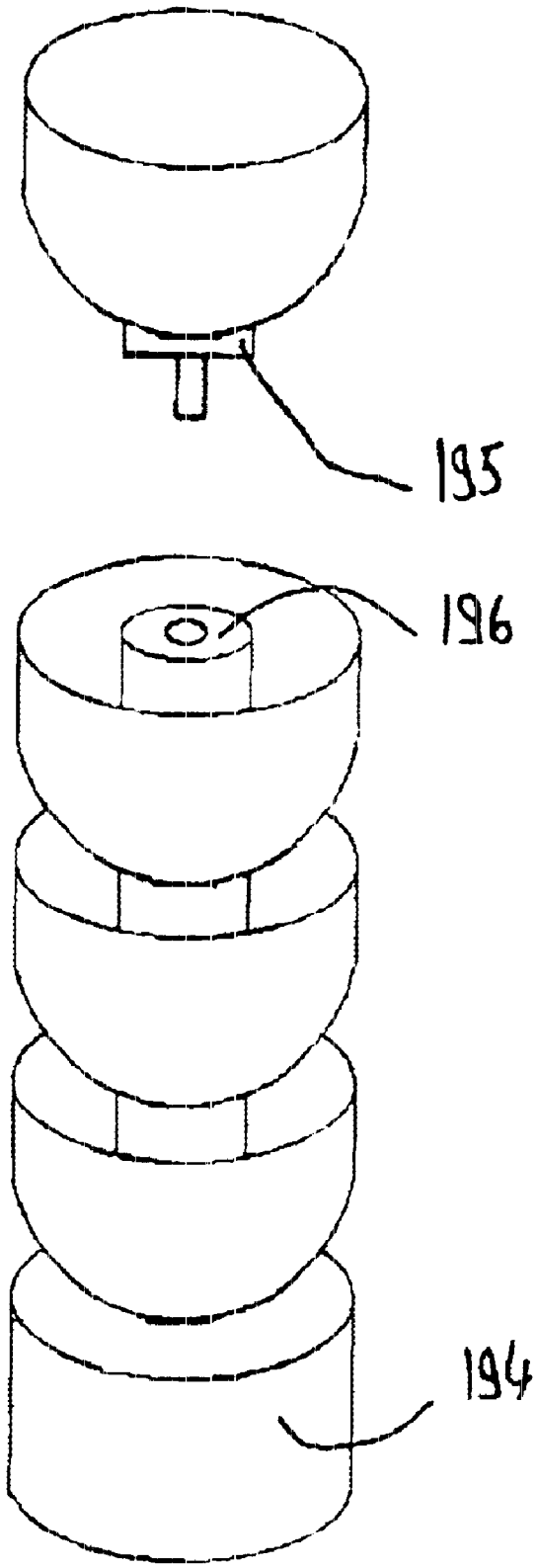
FIG. 23 is a perspective view of a display device.

FIG. 23 shows an embodiment similar to that of FIG. 22 but whose base 194 is of a different shape to the base 191 of FIG. 22. The necessary column is defined by the spacers 195 in conjunction with the bosses 196 (formed integrally with each cup) once the stack has been assembled.

It will of course be understood that the invention is not limited to the specific details described herein, which are given by way of example only, and that various modification and alterations are possible within the scope of the invention.

What is claimed is:

1. A self-standing display device for displaying flowers or the like, the display device comprising: a base; display unit means in the form of a walled vase-like retainer; connecting means linking such display unit means removably to one of the base and another display unit as appropriate; receiving means being provided on one of the base and said display unit means to engage a corresponding connecting means, whereby a stack of such units can be built up as and wherein said connecting means and said receiving means, when engaged together, are rotable relative to one another, whereby the position of the display unit means may be adjusted by the user of said device when the device is assembled.

2. A display device according to claim 1, wherein said receiving means of said display unit means comprises boss means projecting to a height which is substantially the same as the height of the wall of its associated display unit.

3. A display device according to claim 1, wherein the height of the vase-like retainer means measures at least one fifth of the measurement across the rim of the vase-like retainer means.

4. A display device according to claim 2, wherein said boss means projects to a height which is more than the height of the wall of its associated display unit.

5. A display device according claim 2 comprising a column and wherein said boss means is sufficiently hollow to allow the passage of the entire or part of the column through the entire height of said boss means.

6. A display device according to claim 5, wherein the diameter of the column decreases from its base to its top and the diameters of the bosses of the successive display units correspondingly decrease in order to space the successive display units.

* * * * *